US010663167B2

(12) United States Patent
Dziech

(10) Patent No.: US 10,663,167 B2
(45) Date of Patent: May 26, 2020

(54) COMBUSTOR ASSEMBLY WITH CMC COMBUSTOR DOME

(71) Applicant: General Electric Company, Schenectady, NY (US)

(72) Inventor: Aaron Michael Dziech, Crittenden, KY (US)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 15/625,489

(22) Filed: Jun. 16, 2017

(65) Prior Publication Data

US 2018/0363903 A1 Dec. 20, 2018

(51) Int. Cl.

| | |
|---|---|
| ***F23R 3/00*** | (2006.01) |
| ***F23M 5/04*** | (2006.01) |
| ***F23R 3/60*** | (2006.01) |
| ***F23R 3/50*** | (2006.01) |
| ***F23M 5/00*** | (2006.01) |

(52) U.S. Cl.

CPC ..... *F23R 3/007* (2013.01); *F23M 5/00* (2013.01); *F23M 5/04* (2013.01); *F23R 3/002* (2013.01); *F23R 3/50* (2013.01); *F23R 3/60* (2013.01); *F05D 2240/15* (2013.01); *F05D 2240/35* (2013.01); *F05D 2240/90* (2013.01)

(58) Field of Classification Search

CPC . F05D 2240/15; F05D 2260/231; F23M 5/00; F23M 5/04; F23R 3/007; F23R 3/50; F23R 3/60

See application file for complete search history.

(56) References Cited

U.S. PATENT DOCUMENTS 5,015,540 A 5/1991 Borom et al.
5,285,632 A * 2/1994 Halila ..... F23R 3/10 60/747
5,330,854 A 7/1994 Singh et al.
(Continued)

FOREIGN PATENT DOCUMENTS

EP 1635118 A2 3/2006

OTHER PUBLICATIONS

U.S. Appl. No. 15/281,553, filed Sep. 30, 2016.
U.S. Appl. No. 15/281,673, filed Sep. 30, 2016.
U.S. Appl. No. 15/281,698, filed Sep. 30, 2016.

*Primary Examiner* — Scott J Walthour
(74) *Attorney, Agent, or Firm* — Dority & Manning, P.A.

(57) ABSTRACT

Combustor assemblies are provided. An exemplary combustor assembly comprises an annular ceramic matrix composite (CMC) inner liner including an inner liner flange, an annular CMC outer liner including an outer liner flange, and an annular CMC combustor dome comprising a plurality of tiles positioned circumferentially adjacent one another. Each tile has a first end radially opposite a second end. The CMC inner liner, outer liner, and combustor dome form a combustor, and the CMC combustor dome is positioned at a combustor forward end. The combustor assembly also comprises a support structure for supporting the combustor and including an annular frame having a frame channel defining a groove and an inner and outer support flanges. The first end of each tile is disposed within the frame channel groove. The inner liner flange is secured to the inner support flange and the outer liner flange is secured to the outer support flange.

18 Claims, 4 Drawing Sheets

(56) References Cited

U.S. PATENT DOCUMENTS

| | | | | |
|---|---|---|---|---|
| 5,336,350 | A | 8/1994 | Singh | |
| 5,609,031 | A * | 3/1997 | Jones | B21K 25/00 60/753 |
| 5,628,938 | A | 5/1997 | Sangeeta et al. | |
| 6,024,898 | A | 2/2000 | Steibel et al. | |
| 6,258,737 | B1 | 7/2001 | Steibel et al. | |
| 6,403,158 | B1 | 6/2002 | Corman | |
| 6,503,441 | B2 | 1/2003 | Corman et al. | |
| 7,291,407 | B2 | 11/2007 | Merrill et al. | |
| 8,146,372 | B2 | 4/2012 | Carrere et al. | |
| 8,556,531 | B1 | 10/2013 | Bird et al. | |
| 9,423,129 | B2 | 8/2016 | Graves et al. | |
| 9,476,316 | B2 | 10/2016 | Hillier | |
| 2004/0036230 | A1 * | 2/2004 | Matsuda | F01D 9/023 277/632 |
| 2004/0067316 | A1 | 4/2004 | Gray et al. | |
| 2016/0376997 | A1 | 12/2016 | Prociw | |
| 2016/0377292 | A1 | 12/2016 | Prociw | |

* cited by examiner

COMBUSTOR ASSEMBLY WITH CMC COMBUSTOR DOME

FEDERALLY SPONSORED RESEARCH

This invention was made with government support under contract number FA8650-15-D-2501 awarded by the U.S. Department of the Air Force. The government may have certain rights in the invention.

FIELD

The present subject matter relates generally to combustor assemblies for gas turbine engines. More particularly, the present subject matter relates to combustor assemblies utilizing ceramic matrix composite combustor domes.

BACKGROUND

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

Combustion gas temperatures are relatively hot, such that some components in or near the combustion section and the downstream turbine section require features for deflecting or mitigating the effects of the combustion gas temperatures. More commonly, non-traditional high temperature composite materials, such as ceramic matrix composite (CMC) materials, are being used in applications such as gas turbine engine combustion and turbine sections. Components fabricated from CMC materials have a higher temperature capability compared with typical components, e.g., metal components, which may allow improved component performance and/or increased system temperatures. Often, components in direct contact with the hot combustion gases may be fabricated from a CMC material, while combustor assembly support structures comprise metallic components, which are less capable of withstanding high temperatures than CMC components and have different coefficients of thermal expansion (CTE) than CMC components. Therefore, exposing the metallic support structure to the relatively high combustion temperatures risks overheating the metallic support structure and the CTE mismatch between the metallic and CMC components can place undue thermal stresses on CMC components mounted to the metallic support structure.

Accordingly, improved combustion assemblies for mitigating the negative effects of using CMC components with metallic hardware would be desirable. As an example, a combustor assembly having a CMC combustor dome that shields a metallic support structure from a combustion chamber of the combustor assembly would be beneficial. As another example, a combustor assembly that decouples a CMC combustor dome from a structural load path of the combustor assembly would be advantageous. Additionally, a CMC combustor dome formed from a plurality of CMC tiles, e.g., to simplify manufacturing and repair of the dome while also reducing unacceptable natural frequencies of the dome, would be desirable.

BRIEF DESCRIPTION

Aspects and advantages of the invention will be set forth in part in the following description, or may be obvious from the description, or may be learned through practice of the invention.

In one exemplary embodiment of the present subject matter, a combustor assembly is provided. The combustor assembly comprises an annular ceramic matrix composite (CMC) inner liner including an inner liner flange, an annular CMC outer liner radially spaced apart from the CMC inner liner and including an outer liner flange, and an annular CMC combustor dome comprising a plurality of tiles positioned circumferentially adjacent one another. Each tile of the plurality of tiles has a first end radially opposite a second end. The CMC inner liner, the CMC outer liner, and the CMC combustor dome form a combustor that defines a combustion chamber. The CMC combustor dome is positioned at a forward end of the combustor. The combustor assembly also comprises a support structure for supporting the combustor. The support structure includes an annular frame having a frame channel defining a groove, and the first end of each tile of the plurality of tiles disposed within the groove of the frame channel. The support structure further includes an inner support flange and an outer support flange. The inner liner flange is secured to the inner support flange and the outer liner flange is secured to the outer support flange.

In another exemplary embodiment of the present subject matter, a combustor assembly is provided. The combustor assembly comprises an annular ceramic matrix composite (CMC) inner liner including an inner liner flange, an annular CMC outer liner radially spaced apart from the CMC inner liner and including an outer liner flange; and an annular CMC combustor dome having a first end and a radially opposite second end. The CMC inner liner, the CMC outer liner, and the CMC combustor dome form a combustor that defines a combustion chamber, and the CMC combustor dome is positioned at a forward end of the combustor. The combustor assembly further comprises a support structure for supporting the combustor. The support structure includes an annular frame, an inner support flange, and an outer support flange. The combustor assembly also comprises an inner CMC bracket including an inner bracket channel and an outer CMC bracket including an outer bracket channel. The first end of the CMC combustor dome is disposed within the inner bracket channel, and the second end of the CMC combustor dome is disposed within the outer bracket channel.

In a further exemplary embodiment of the present subject matter, a combustor assembly is provided. The combustor assembly comprises an annular ceramic matrix composite (CMC) inner liner including an inner liner flange, an annular CMC outer liner radially spaced apart from the CMC inner liner and including an outer liner flange, and an annular CMC combustor dome having a first end and a second end. The CMC inner liner, the CMC outer liner, and the CMC combustor dome form a combustor that defines a combustion chamber, and the CMC combustor dome is positioned at a forward end of the combustor. The combustor assembly also includes a CMC bracket including a bracket channel and a support structure for supporting the combustor. The support structure includes an annular frame including a frame channel, an inner support flange, and an outer support flange. The first end of the CMC combustor dome is disposed within the frame channel, and the second end of the CMC combustor dome is disposed within the bracket channel. Moreover, the CMC combustor dome is positioned between the support structure and the combustion chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
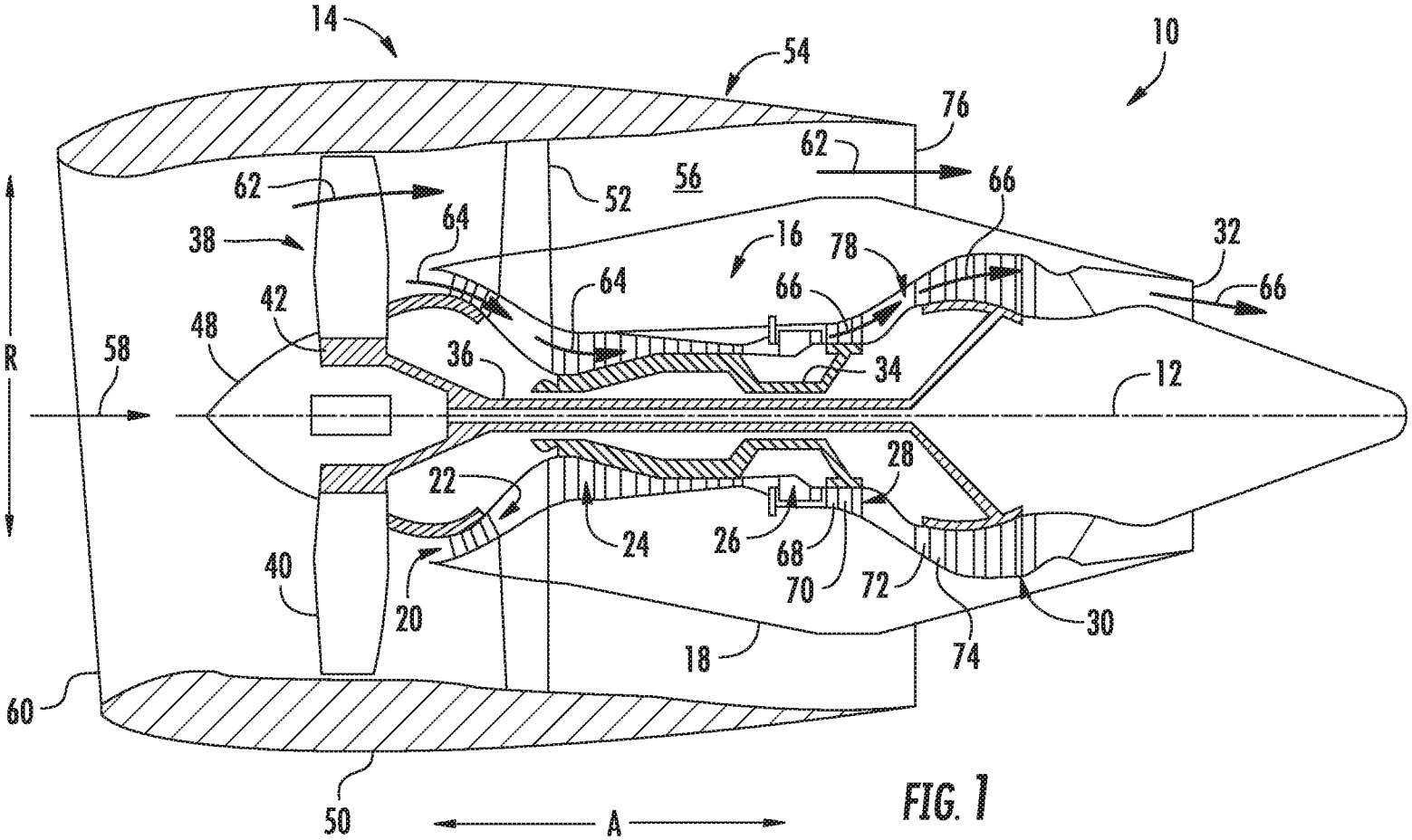
FIG. 1 provides a schematic cross-section view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. In other embodiments of turbofan engine 10, additional spools may be provided such that engine 10 may be described as a multi-spool engine.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters turbofan 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It will be appreciated that, although described with respect to turbofan 10 having core turbine engine 16, the present subject matter may be applicable to other types of turbomachinery. For example, the present subject matter may be suitable for use with or in turboprops, turboshafts, turbojets, industrial and marine gas turbine engines, and/or auxiliary power units.

Figure 2:
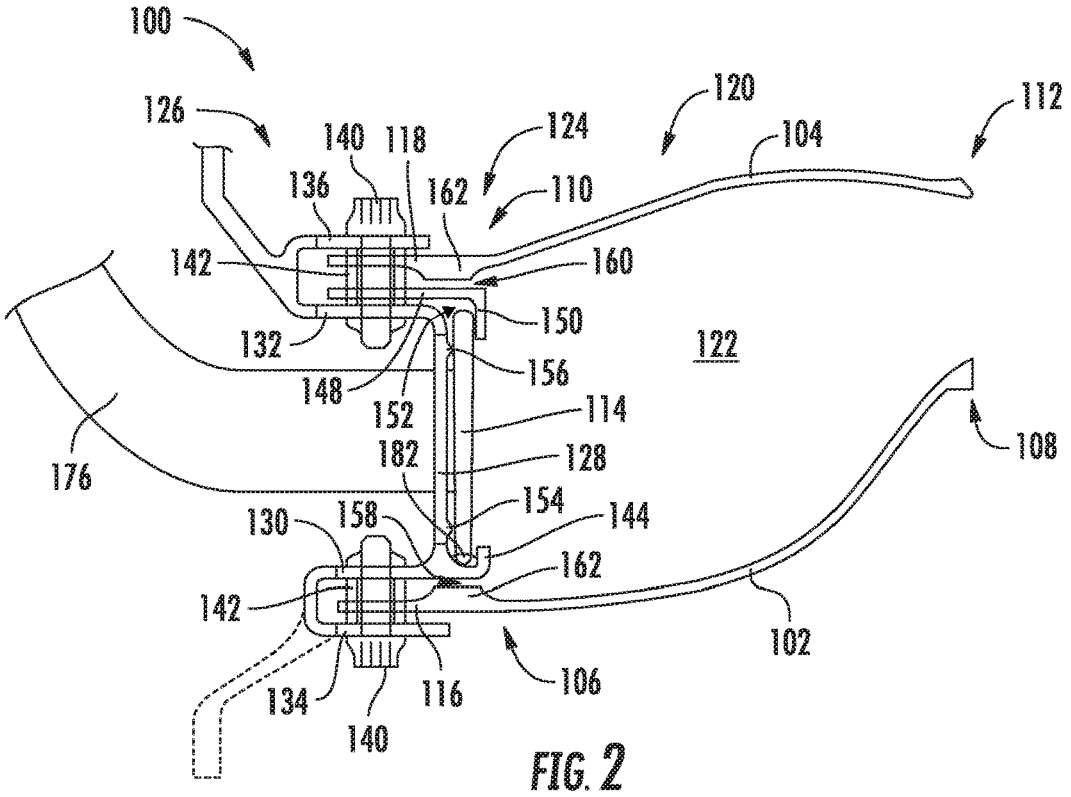
FIG. 2 provides a schematic cross-section view of a combustor assembly of the gas turbine engine of FIG. 1, according to an exemplary embodiment of the present subject matter.

FIG. 2 provides a schematic cross-sectional view of a combustor assembly 100, e.g., for use in the gas turbine engine of FIG. 1, according to an exemplary embodiment of the present subject matter. As shown in FIG. 2, the combustor assembly 100 comprises an annular inner liner 102 and an annular outer liner 104; the outer liner 104 is radially spaced apart from the inner liner 102. The inner liner 102 extends generally along the axial direction A between an upstream end 106 and a downstream end 108. Similarly, the outer liner 104 extends generally along the axial direction A between an upstream end 110 and a downstream end 112. A combustor dome 114 extends generally along the radial direction R between the upstream end 106 of the inner liner 102 and the upstream end 110 of the outer liner 104. The inner liner 102 includes an inner liner flange 116 that extends forward from the upstream end 106 of the inner liner. The outer liner 104 also includes an outer liner flange 118 that extends forward from the upstream end 110 of the outer liner 104. The combustor dome 114 is disposed generally at the transition between the inner liner 102 and the inner liner flange 116 and the transition between the outer liner 104 and the outer liner flange 118. Further, the inner liner 102, the outer liner 104, and the combustor dome 114 form a combustor 120 that defines a combustion chamber 122. The combustor dome 114 is positioned at a forward end 124 of the combustor 120.

The inner and outer liners 102, 104 and their respective flanges 116, 118, as well as the combustor dome 114, comprise a ceramic matrix composite (CMC) material, which is a non-metallic material having high temperature capability. As such, the inner liner 102 may be referred to as CMC inner liner 102, the outer liner 104 may be referred to as CMC outer liner 104, and the combustor dome 114 may be referred to as CMC combustor dome 114. Exemplary CMC materials and methods or techniques for forming CMC components are described in greater detail below.

The combustor 120 is supported within the gas turbine engine by a support structure 126. More particularly, the support structure 126 supports the inner and outer liners 102, 104 and the combustor dome 114, thereby supporting the combustor 120. Further, the CMC combustor dome 114 is positioned between the support structure 126 and the combustion chamber 122, such that the CMC combustor dome 114 shields the support structure 126 from direct interaction with the environment within the combustion chamber 122, such as the relatively extreme temperatures of the combustion gases 66. Accordingly, because the CMC combustor dome 114 shields the support structure 126 from the combustion chamber 122, the support structure 126 may be formed from a metallic material, such as a metal or metal alloy, which has a lower temperature capability that the CMC combustor dome 114.

Figure 3:
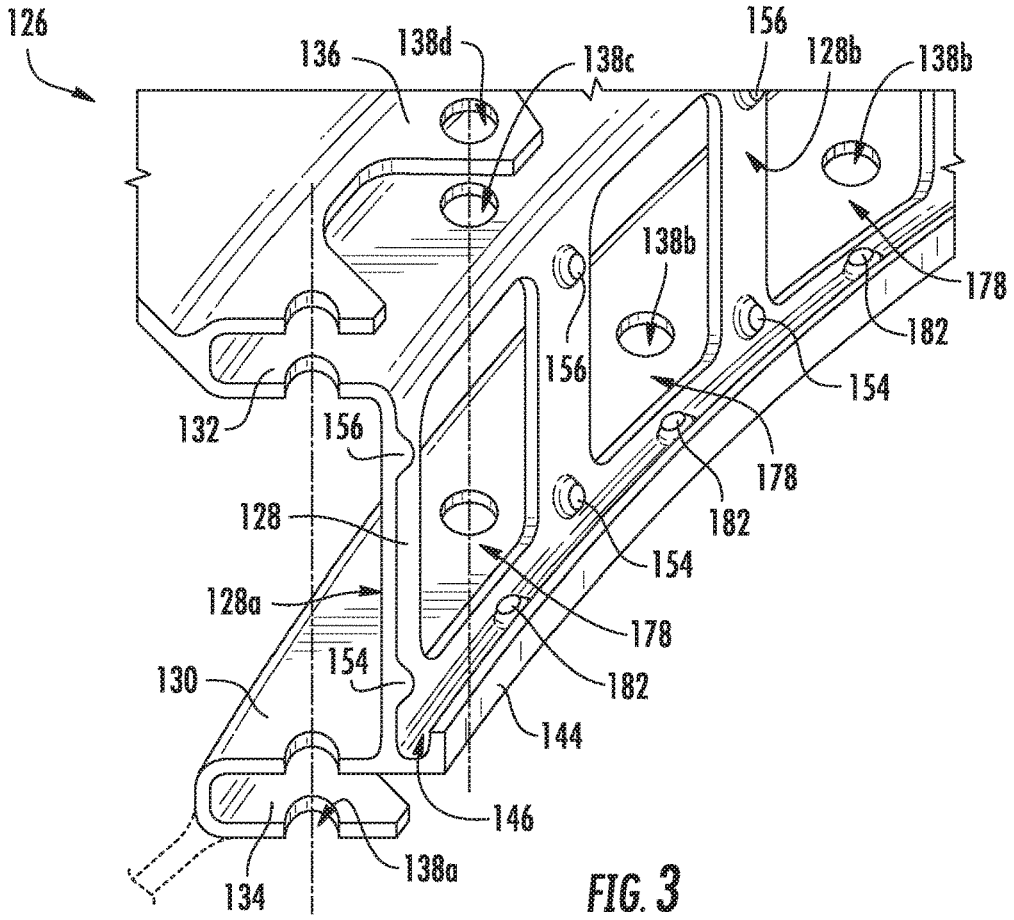
FIG. 3 provides a perspective, aft side view of a portion of a support structure of the combustor assembly of FIG. 2, according to an exemplary embodiment of the present subject matter.

As illustrated in FIGS. 2 and 3, the support structure 126 includes an annular frame 128 having an inner member 130 and an outer member 132. The inner member 130 extends generally axially forward from a forward surface 128*a* of the frame at a frame inner end, and the outer member 132 extends generally axially forward from the forward surface 128*a* at a frame outer end. The support structure 126 further includes an inner support flange 134 and an outer support flange 136. The inner member 130 is connected to but radially spaced apart from the inner support flange 134; similarly, the outer member 132 is connected to but radially spaced apart from the outer support flange 136.

As shown in FIG. 3, the inner support flange 134, inner member 130, outer member 132, and outer support flange 136 each define a plurality of apertures 138 spaced apart along a circumferential direction C. The inner support flange 134 defines a plurality of apertures 138*a*, the inner member 130 defines a plurality of apertures 138*b*, the outer member 130 defines a plurality of apertures 138*c*, and the outer support flange 136 defines a plurality of apertures 138*d*. Each aperture 138*a* is radially aligned with one of the apertures 138*b*, each aperture 138*b* is radially aligned with one of the apertures 138*c*, and each aperture 138*c* is radially aligned with one of the apertures 138*d*.

Referring to FIG. 2, it will be appreciated that the inner liner flange 116 and the outer liner flange 118 similarly each define a plurality of apertures spaced apart along the circumferential direction C. Each inner liner flange aperture is radially aligned with one of the inner support flange apertures 138*a*, one of the inner member apertures 138*b*, one of the outer member apertures 138*c*, and one of the outer support flange apertures 138*d* to form a radial series of inner apertures. Further, each outer liner flange aperture is radially aligned with one of the inner support flange apertures 138*a*, one of the inner member apertures 138*b*, one of the outer member apertures 138*c*, and one of the outer support flange apertures 138*d* to form a radial series of outer apertures. An attachment mechanism 140 extends through each series of inner apertures and through each series of outer apertures to hold the support structure 126, inner liner 102, and outer liner 104 in position with respect to one another. As shown in FIG. 2, the inner liner flange 116 is secured to the inner support flange 134, and the outer liner flange 118 is secured to the outer support flange 136.

The attachment mechanisms 140 may be bolts, pins, or other suitable fasteners. Moreover, each of the inner liner flange apertures and outer liner flange apertures may include a grommet (not shown), which helps these components move radially along a bushing 142 positioned over the attachment mechanism 140 while preventing or reducing wear on the components, as well as binding of the components. The grommets may be particularly useful where the inner and outer liners 102, 104 are formed from a CMC material.

As shown in FIGS. 2 and 3, the frame 128 of the support structure 126 includes a frame channel 144. In the depicted embodiment, the frame channel 144 extends generally axially aft from an aft surface 128*b* of the frame 128 at the frame inner end such that the frame channel 144 is defined opposite the inner member 130. The frame channel 144 defines a groove 146 for receipt of an inner end of the combustor dome 114, as described in greater detail below.

Additionally, the combustor assembly 100 comprises an annular CMC bracket 148 that includes a bracket channel 150 defining a groove 152. The groove 152 is configured for receipt of an outer end of the combustor dome 114, as described in greater detail below. The CMC bracket 148 is secured between the outer liner flange 118 and the outer support flange 136 such that the CMC bracket 148 extends axially aft with respect to the support structure 126. It will be understood that the CMC bracket 148 defines a plurality of apertures spaced apart along the circumferential direction C, and each bracket aperture is aligned with a radial series of outer apertures such that an attachment mechanism 140 extends through each radially aligned outer support flange aperture 138*d*, outer liner flange aperture, bracket aperture, and outer member aperture 138*c* as illustrated in FIG. 2. Like each of the inner liner flange apertures and outer liner flange apertures, each of the bracket apertures may include a grommet (not shown), which helps the CMC bracket 148 move radially along the bushing 142 positioned over the attachment mechanism 140 while preventing or reducing wear on the bracket 148, as well as binding of the bracket 148.

In some embodiments, the CMC bracket 148 may be segmented along the circumferential direction into a plurality of CMC bracket sections that together form the annular CMC bracket 148. Thus, each bracket section includes a portion of the bracket channel 150 and defines one or more of the circumferentially spaced apart apertures for securing the bracket section with attachment mechanism(s) 140. As appropriate, one or more seals may be positioned between the circumferential edges of each bracket section, e.g., to prevent fluid leakage from the combustion chamber 122 through the crack or discontinuity formed between each bracket section.

As illustrated in FIG. 2, the CMC combustor dome 114 is separated from the structural load path. More particularly, the CMC combustor dome 114 is secured in place by its receipt within the frame channel 144 and the bracket channel 150, i.e., in the depicted embodiment, a first end of the dome 114 is disposed within the frame channel 144 and a second end is disposed within the bracket channel 150. In contrast, the CMC inner and outer liners 102, 104 are mounted to the support structure 126 with inner and outer mounts, i.e., inner and outer members 130, 132 and inner and outer support flanges 134, 136. As such, the dome 114 is not mounted to the inner or outer mounts of the support structure 126 but is supported and restrained by the support structure 126 without undue or unacceptable thermal strain on the CMC combustor dome 114 due to the differences in thermal expansion between the metallic support structure 126 and the CMC dome 114.

Referring still to FIGS. 2 and 3, the frame 128 of the support structure 126 includes a plurality of first projections 154 and a plurality of second projections 156, the plurality of second projections 156 radially spaced apart from the plurality of first projections 154. The plurality of first projections 154 and the plurality of second projections 156 are configured to axially load the CMC combustor dome 114 into the frame channel 144 and the CMC bracket channel 150. As such, the first and second projections 154, 156 help keep the CMC combustor dome 114 reasonably tight against the channels 144, 150 and thereby help hold the dome 114 in a proper position within the combustor assembly 100.

Further, as illustrated in FIG. 2, a first airflow opening 158 is defined between the inner liner flange 116 and the frame channel 144, and a second airflow opening 160 is defined between the outer liner flange 118 and the CMC bracket 148. The airflow openings 158, 160 provide a flow of air to the combustion chamber 122. In exemplary embodiments, the inner liner flange 116 and the outer liner flange 118 each define a protrusion 162 within the airflow openings 158, 160. Each protrusion 162 may be machinable to help control the width of the gap between the inner liner flange 116 and the frame channel 144 and between the outer liner flange 118 and the CMC bracket 148, thereby controlling the flow of air through the airflow openings 158, 160. For example, each protrusion 162 may be formed from a buildup of CMC plies, e.g., a CMC ply stack or a plurality of CMC plies laid up with the CMC material forming the inner liner 102 and the outer liner 104. The buildup may be machined to define protrusions 162 on the inner and outer liner flanges 116, 118 and/or to more precisely define the width of the airflow openings 158, 160.

Figure 4:
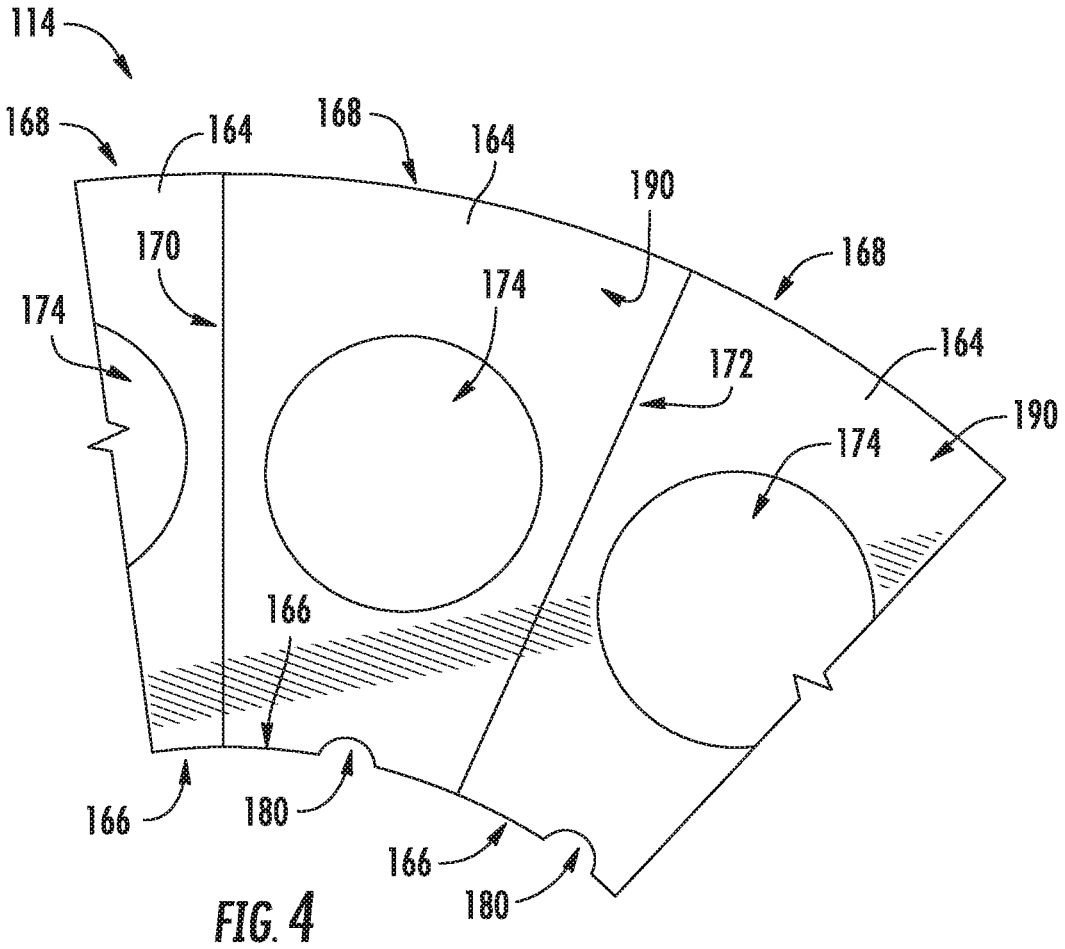
FIG. 4 provides an aft side view of a portion of a plurality of tiles forming a combustor dome of the combustor assembly of FIG. 2, according to an exemplary embodiment of the present subject matter.

Turning now to FIG. 4, in an exemplary embodiment of the present subject matter, the annular CMC combustor dome 114 comprises a plurality of CMC tiles 164. The tiles 164 are positioned circumferentially adjacent one another to form the annular dome 114. As such, the tiles 164 circumferentially segment the CMC combustor dome 114 into a plurality of segments. Accordingly, the tiles 164 may simplify the manufacturing of the CMC combustor dome 114, e.g., forming dome segments (i.e., tiles 164) from a CMC material may be simpler than forming a single piece annular combustor dome from a CMC material because the tile segments have a simpler shape than an annular dome. Moreover, the tiles 164 may simplify repair of the dome 114 because individual tiles 164 may be replaced rather than the entire dome 114. Further, segmenting the CMC combustor dome 114 into a plurality of tiles 164 may help reduce unacceptable natural frequencies with respect to the dome. For example, the segmented CMC combustor dome 114 has a higher natural frequency and increased damping, which lowers problems with dome vibration within the combustor assembly 110.

Each tile 164 of the plurality of tiles 164 has a first end 166 radially opposite a second end 168. As shown in FIG. 4, the first end 166 may be an inner end of the tile 164, while the second end 168 may be an outer end of the tile 164. Each tile 164 also has a first side 170 circumferentially opposite a second side 172, and each of the first side 170 and second side 172 defines a radially extending edge of the tile 164. Notably, each tile 164 defines an aperture 174 therein, and a fuel nozzle 176 (FIG. 2) is received in each aperture 174.

Referring back to FIG. 2, the first end 166 of each tile 164 of the plurality of tiles 164 forming the combustor dome 114 is disposed within the frame channel 144, i.e., within the groove 146 defined by the frame channel 144. Similarly, the second end 168 of each tile 164 is disposed within the bracket channel 150, i.e., within the groove 152 defined by the bracket channel 150. As such, the frame channel 144 and the bracket channel 150 secure the tiles 164 in place within the combustor assembly 100. Further, the frame channel 144 and the bracket channel 150 secure the tiles 164 in place with respect to the support structure 126. As shown in FIG. 3, the frame 128 of the support structure 126 further defines a plurality of windows 178 that generally correspond to the tile apertures 174. As such, each fuel nozzle 176 is disposed through a window 178 of the plurality of windows 178 of the frame 128 to be received in a tile aperture 174.

As further illustrated in FIG. 4, each tile 164 defines a slot 180, and as shown in FIG. 2, the frame channel 144 includes a plurality of ribs 182. A rib 182 of the plurality of ribs 182 is received in each slot 180 to help prevent rotation of the tiles 164. That is, the slots 180 and ribs 182 are anti-rotation features that help hold the tiles 164 in a proper position. In the depicted embodiment, the slots 180 are defined along the first end 166 of each tile 164, but in other embodiments, the slots 180 may be defined along the first side 170 or the second side 172 of each tile 164. Of course, depending on the location of slots 180, the frame 128 or frame channel 144 includes the ribs 182 at a proper location for the ribs 182 to be received within the slots 180.

Figure 5:
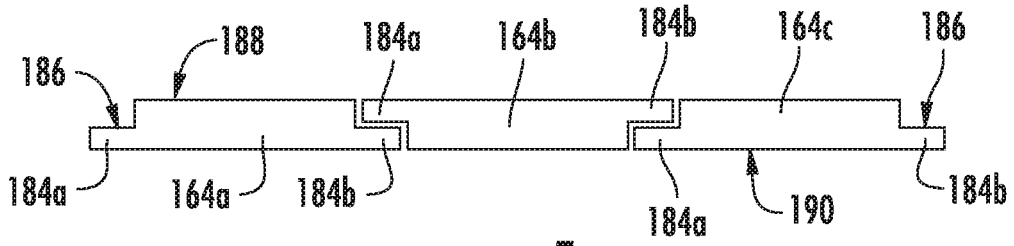
FIG. 5 provides a schematic circumferential cross-section view of a portion of the plurality of tiles of FIG. 4, according to an exemplary embodiment of the present subject matter.

Turning now to FIG. 5, a circumferential cross-section view is provided of adjacent tiles 164 forming the CMC combustor dome 114, according to an exemplary embodiment of the present subject matter. As illustrated in FIG. 5, each tile 164 defines an overlap portion 184 along each radial edge defined by the first and second sides 170, 172, and the overlap portions 184 of adjacent tiles 164 overlap one another. More specifically, each overlap portion 184 defines an interface surface 186 along which the overlap portion 184 of the adjacent tile 164 interfaces. That is, as shown in FIG. 5, the interface surface 186 of a second overlap portion 184*b* of a first tile 164*a* contacts or interfaces with the interface surface 186 of a first overlap portion 184*a* of a second tile 164*b*. Similarly, the interface surface 186 of a second overlap portion 184*b* of the second tile 164*b* contacts or interfaces with the interface surface 186 of a first overlap portion 184*a* of a third tile 164*c*. Further, as illustrated in FIG. 5, where the overlap portions 184 are defined on the tile 164 alternates between adjacent tiles 164. For example, the overlap portions 184 of the first tile 164*a* and the third tile 164*c* are defined adjacent a forward surface 188 of each tile, while the overlap portions 184 of the second tile 164*b* are defined adjacent an aft surface 190 of the tile. As such, the first overlap portion 184*a* of the second tile 164*b* interfaces with the second overlap portion 184*b* of the first tile 164*a*, and the second overlap portion 184*b* of the second tile 164*b* interfaces with the first overlap portion 184*a* of the third tile 164*c*. The alternating pattern shown in FIG. 5 may be continued for each tile 164 forming the combustor dome 114. Other patterns may be used as well; for instance, the first overlap portion 184*a* of each tile 164 may be defined adjacent the forward surface 188 and the second overlap portion 184*b* of each tile 164 defined adjacent the aft surface 190, such that the first overlap portion 184*a* of each tile 164 interfaces with the second overlap portion 184*b* of the adjacent tile 164.

It will be understood that, for the plurality of tiles 164 forming the CMC combustor dome 114, each tile side 170, 172 may define an overlap portion 184 that overlaps with an overlap portion 184 defined by an adjacent tile side 170, 172 such that the dome 114 comprises a plurality of tiles 164 having overlapping edges. The overlapping tile edges provide a seal between each tile 164, e.g., to help prevent fluid leakage from the combustion chamber 122 through the crack or discontinuity formed between each tile 164. Of course, in other embodiments, the overlap portions 184 may be omitted such that each tile has substantially planar radial edges along sides 170, 172, and another sealing mechanism, such as a spline seal or the like, used between adjacent tile sides 170, 172 to help prevent leakage around the tiles 164.

Referring back to FIG. 3, the inner support flange 134 and the outer support flange 136 are scalloped along the circumferential direction C. More particularly, as illustrated in FIG. 3, material forming the support structure 126 surrounds each inner support flange aperture 138*a* and each outer support flange aperture 138*d*, but less material extends between each aperture 138*a*, 138*d*. The scalloped edges 192 reduce the amount of material required to fabricate the support structure 126, which may reduce engine weight and part cost, as well as reduce the amount of material of the support structure 126 in proximity to the combustor 120, which may reduce the transfer of heat to the support structure 126 and allow an air buffer between portions of the support structure and the CMC combustor dome 114.

Figure 6:
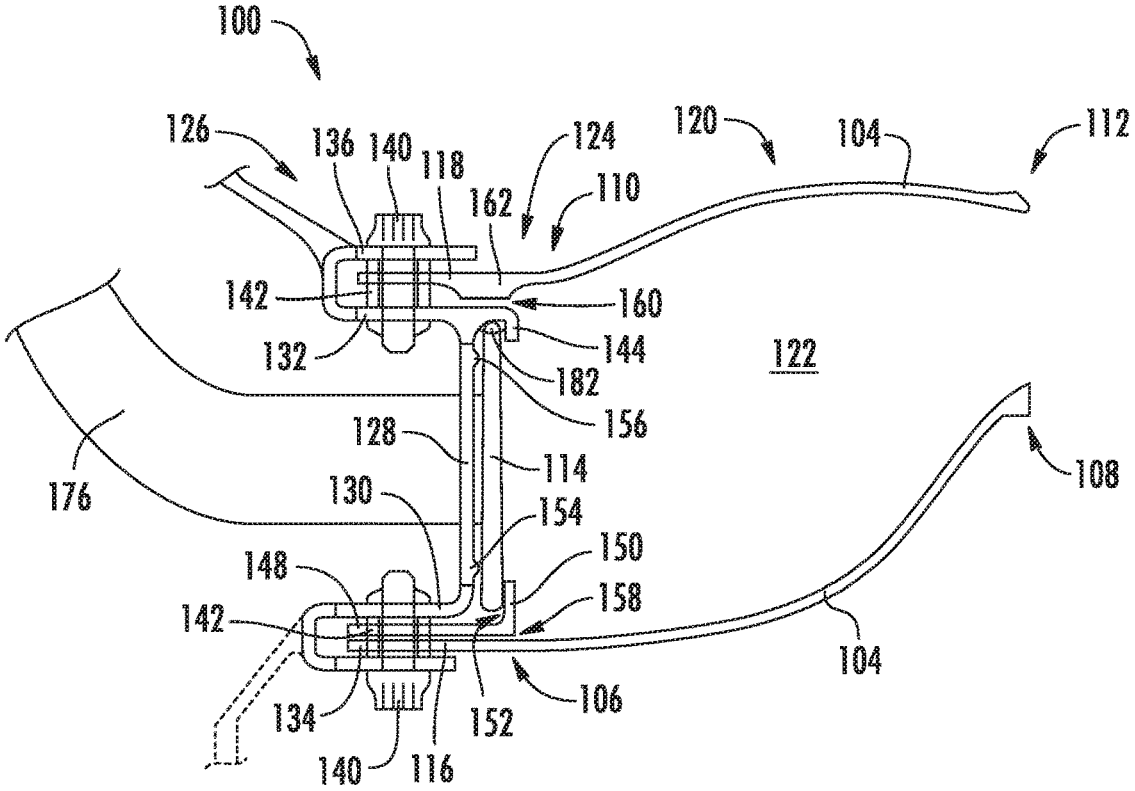
FIGS. 6 and 7 provide schematic cross-section views of a combustor assembly of the gas turbine engine of FIG. 1, according to other exemplary embodiments of the present subject matter.
Figure 7:
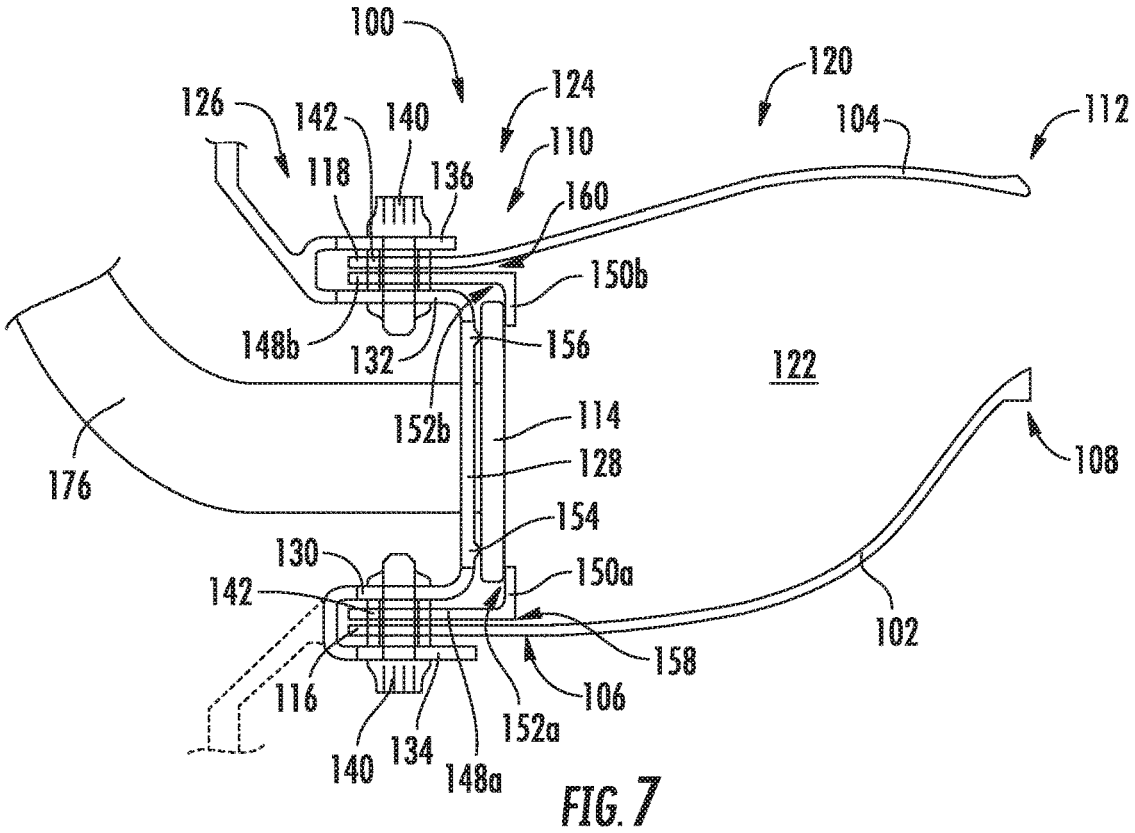

FIGS. 6 and 7 illustrate other exemplary embodiments of the combustor assembly 100. FIG. 6 depicts an embodiment of the combustor assembly 100 in which the frame channel 144 extends generally axially aft from an aft surface 128*b* of the frame 128 at the frame outer end such that the frame channel 144 is defined opposite the outer member 132. Additionally, the CMC bracket 148 is secured between the inner liner flange 116 and the inner support flange 134. As such, the frame channel 144 and the CMC bracket 148 are in radially opposite positions in the embodiment of FIG. 6 compared to the embodiment illustrated in FIGS. 2 and 3. Accordingly, the first end 166 of each tile 164 of the plurality of CMC tiles 164 forming the dome 114 is disposed within the bracket channel 150, i.e., within the groove 152 of the channel 150. Further, the second end 168 of each tile 164 is disposed within the frame channel 144, i.e., within the groove 146 of the channel 144. Thus, the slots 180 may be defined in the second end 168 of each tile 164 such that the ribs 182 included in the frame channel 144 may be received within the slots 180. Otherwise, the embodiment of FIG. 6 is substantially the same as the embodiment illustrated in FIGS. 2-5, such that the foregoing description of FIGS. 2-5 substantially applies to the embodiment of FIG. 6, as indicated by the use of common reference numerals.

In the embodiment depicted in FIG. 7, a CMC bracket 148 is used in place of the frame channel 144, such that the embodiment utilizes two CMC brackets 148*a*, 148*b* and omits the frame channel 144. More particularly, the combustor assembly 100 includes an inner CMC bracket 148*a* that includes an inner bracket channel 150*a* defining a groove 152*a* and an outer CMC bracket 148*b* that includes an outer bracket channel 150*b* defining a groove 152*b*. As such, the first end 166 of each tile 164 of the plurality of CMC tiles 164 forming the dome 114 is disposed within the inner bracket channel 150*a*, i.e., within the groove 152*a* of the channel 150*a*. Further, the second end 168 of each tile 164 is disposed within the outer bracket channel 150*b*, i.e., within the groove 152*b* of the channel 150*b*. Thus, the plurality of first frame projections 154 and the plurality of second frame projections 156 load the CMC combustor dome 114 into the inner bracket channel 150*a* and the outer bracket channel 150*b*. Moreover, the frame 128, rather than a frame channel 144, defines the plurality of ribs 182 that are received in slots 180 of the CMC dome tiles 164. It will be appreciated that the slots 180, therefore, may be defined other than on an end of the tiles 164 as illustrated in FIG. 4. For example, the slots 180 may be defined radially outward from the first end 166 or radially inward from the second end 168, or the slots may be defined along one of the sides 170, 172. In another configuration of the embodiment of FIG. 7, the combustor dome 114 may be a single piece combustor dome 114 rather than a dome formed from a plurality of tiles 164. Utilizing two CMC brackets 148 allows, for example, a single piece combustor dome 114 to be installed in the combustor assembly 100. Otherwise, in either of the foregoing configurations, the embodiment of FIG. 7 is substantially the same as the embodiment illustrated in FIGS. 2-5, such that the foregoing description of FIGS. 2-5 substantially applies to the embodiment of FIG. 7, as indicated by the use of common reference numerals.

As described herein, the inner and outer liners 102, 104, bracket 148, and the tiles 164 forming the combustor dome 114 may be formed from a ceramic matrix composite (CMC) material, which is a non-metallic material having high temperature capability. It may be particularly useful to utilize CMC materials in or near the hot gas path 78 due to the relatively high temperatures of the combustion gases 66, and the use of CMC materials within the combustor assembly 100 may allow reduced cooling airflow to the CMC components and higher combustion temperatures, as well as other benefits and advantages. However, other components of the turbofan engine 10, such as components of HP compressor 24, HP turbine 28, and/or LP turbine 30, also may comprise a CMC material.

Exemplary CMC materials utilized for such components may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration or chemical vapor infiltration with silicon, to arrive at a component formed of a CMC material having a desired chemical composition. In other embodiments, the CMC material may be formed as, e.g., a carbon fiber cloth rather than as a tape.

More specifically, examples of CMC materials, and particularly SiC/Si—SiC (fiber/matrix) continuous fiber-reinforced ceramic composite (CFCC) materials and processes, are described in U.S. Pat. Nos. 5,015,540; 5,330,854; 5,336,350; 5,628,938; 6,024,898; 6,258,737; 6,403,158; and 6,503,441, and U.S. Patent Application Publication No. 2004/0067316. Such processes generally entail the fabrication of CMCs using multiple pre-impregnated (prepreg) layers, e.g., the ply material may include prepreg material consisting of ceramic fibers, woven or braided ceramic fiber cloth, or stacked ceramic fiber tows that has been impregnated with matrix material. In some embodiments, each prepreg layer is in the form of a "tape" comprising the desired ceramic fiber reinforcement material, one or more precursors of the CMC matrix material, and organic resin binders. Prepreg tapes can be formed by impregnating the reinforcement material with a slurry that contains the ceramic precursor(s) and binders. Preferred materials for the precursor will depend on the particular composition desired for the ceramic matrix of the CMC component, for example, SiC powder and/or one or more carbon-containing materials if the desired matrix material is SiC. Notable carbon-containing materials include carbon black, phenolic resins, and furanic resins, including furfuryl alcohol ($C_4H_3OCH_2OH$). Other typical slurry ingredients include organic binders (for example, polyvinyl butyral (PVB)) that promote the flexibility of prepreg tapes, and solvents for the binders (for example, toluene and/or methyl isobutyl ketone (MIBK)) that promote the fluidity of the slurry to enable impregnation of the fiber reinforcement material. The slurry may further contain one or more particulate fillers intended to be present in the ceramic matrix of the CMC component, for example, silicon and/or SiC powders in the case of a Si—SiC matrix. Chopped fibers or whiskers or other materials also may be embedded within the matrix as previously described. Other compositions and processes for producing composite articles, and more specifically, other slurry and prepreg tape compositions, may be used as well, such as, e.g., the processes and compositions described in U.S. Patent Application Publication No. 2013/0157037.

The resulting prepreg tape may be laid-up with other tapes, such that a CMC component formed from the tape comprises multiple laminae, each lamina derived from an individual prepreg tape. Each lamina contains a ceramic fiber reinforcement material encased in a ceramic matrix formed, wholly or in part, by conversion of a ceramic matrix precursor, e.g., during firing and densification cycles as described more fully below. In some embodiments, the reinforcement material is in the form of unidirectional arrays of tows, each tow containing continuous fibers or filaments. Alternatives to unidirectional arrays of tows may be used as well. Further, suitable fiber diameters, tow diameters, and center-to-center tow spacing will depend on the particular application, the thicknesses of the particular lamina and the tape from which it was formed, and other factors. As described above, other prepreg materials or non-prepreg materials may be used as well.

After laying up the tapes or plies to form a layup, the layup is debulked and, if appropriate, cured while subjected to elevated pressures and temperatures to produce a preform. The preform is then heated (fired) in a vacuum or inert atmosphere to decompose the binders, remove the solvents, and convert the precursor to the desired ceramic matrix material. Due to decomposition of the binders, the result is a porous CMC frame that may undergo densification, e.g., melt infiltration (MI), to fill the porosity and yield the CMC component. Specific processing techniques and parameters for the above process will depend on the particular composition of the materials. For example, silicon CMC components may be formed from fibrous material that is infiltrated with molten silicon, e.g., through a process typically referred to as the Silcomp process. Another technique of manufacturing CMC components is the method known as the slurry cast melt infiltration (MI) process. In one method of manufacturing using the slurry cast MI method, CMCs are produced by initially providing plies of balanced two-dimensional (2D) woven cloth comprising silicon carbide (SiC)-containing fibers, having two weave directions at substantially 90° angles to each other, with substantially the same number of fibers running in both directions of the weave. The term "silicon carbide-containing fiber" refers to a fiber having a composition that includes silicon carbide, and preferably is substantially silicon carbide. For instance, the fiber may have a silicon carbide core surrounded with carbon, or in the reverse, the fiber may have a carbon core surrounded by or encapsulated with silicon carbide.

Other techniques for forming CMC components include polymer infiltration and pyrolysis (PIP) and oxide/oxide processes. In PIP processes, silicon carbide fiber preforms are infiltrated with a preceramic polymer, such as polysilazane and then heat treated to form a SiC matrix. In oxide/oxide processing, aluminum or alumino-silicate fibers may be pre-impregnated and then laminated into a preselected geometry. Components may also be fabricated from a carbon fiber reinforced silicon carbide matrix (C/SiC) CMC. The C/SiC processing includes a carbon fibrous preform laid up on a tool in the preselected geometry. As utilized in the slurry cast method for SiC/SiC, the tool is made up of graphite material. The fibrous preform is supported by the tooling during a chemical vapor infiltration process at about 1200° C., whereby the C/SiC CMC component is formed. In still other embodiments, 2D, 2.5D, and/or 3D preforms may be utilized in MI, CVI, PIP, or other processes. For example, cut layers of 2D woven fabrics may be stacked in alternating weave directions as described above, or filaments may be wound or braided and combined with 3D weaving, stitching, or needling to form 2.5D or 3D preforms having multiaxial fiber architectures. Other ways of forming 2.5D or 3D preforms, e.g., using other weaving or braiding methods or utilizing 2D fabrics, may be used as well.

Thus, a variety of processes may be used to form CMC gas turbine components, such as a CMC inner liner 102, a CMC outer liner 104, a CMC bracket 148, and CMC dome tiles 164, which form a CMC combustor dome 114. Of course, other suitable processes, including variations and/or combinations of any of the processes described above, also may be used to form CMC components for use with the various retention assembly and flowpath assembly embodiments described herein.

As described herein, the present subject matter provides a combustor assembly having a CMC combustor dome that is separated from the structural load path, thereby minimizing stress and strain levels in the dome, and that shields its metallic support structure from the combustion chamber of the combustor assembly, which helps control thermal deflection and thermal stress of the metallic support structure. The combustor assembly also may utilize CMC inner and outer combustor liners. As described above, using CMC materials to form the combustor dome and liners may reduce the cooling required by the dome and liners while also allowing increased combustion temperatures, which may increase engine performance. Preferably, the CMC combustor dome is formed from a plurality of CMC dome tiles, which circumferentially segment the dome into a plurality of segments. Utilizing a plurality of CMC dome tiles rather than a single piece CMC combustor dome may simplify manufacturing of the dome as well as repair of the dome, as each dome tile may be individually replaced. Moreover, a segmented CMC combustor dome may reduce vibration within the combustor assembly by increasing the natural frequency and damping of the dome. Of course, the present subject matter may have other benefits and advantages as well.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A combustor assembly, comprising:

an annular ceramic matrix composite (CMC) inner liner including an inner liner flange;

an annular CMC outer liner spaced apart from the annular CMC inner liner along a radial direction, the annular CMC outer liner including an outer liner flange;

an annular CMC combustor dome having a first end and a second end, wherein the annular CMC inner liner, the annular CMC outer liner, and the annular CMC combustor dome form a combustor that defines a combustion chamber, the annular CMC combustor dome positioned at a forward end of the combustor;

a CMC bracket including a first bracket portion and a bracket channel at an aft end of the bracket and aft of the first bracket portion, the bracket channel being perpendicular to the first bracket portion; and a support structure for supporting the combustor, the support structure including an annular frame, an inner support flange, and an outer support flange, wherein the first bracket portion, the bracket channel, and the annular frame define a groove, wherein one of the first end or the second end of the annular CMC combustor dome is disposed within the groove, and wherein the annular CMC combustor dome is positioned between the support structure and the combustion chamber, and wherein an attachment mechanism extends through both the CMC bracket and one of the inner liner flange or the outer liner flange to secure the CMC bracket between either the annular CMC inner liner or the annular CMC outer liner and the support structure.

2. A combustor assembly, comprising:

an annular ceramic matrix composite (CMC) inner liner including an inner liner flange;

an annular CMC outer liner spaced apart from the annular CMC inner liner along a radial direction, the annular CMC outer liner including an outer liner flange;

an annular CMC combustor dome comprising a plurality of tiles positioned circumferentially adjacent one another, each tile of the plurality of tiles having a first end opposite a second end along the radial direction and a first side opposite a second side along a circumferential direction, wherein the annular CMC inner liner, the annular CMC outer liner, and the annular CMC combustor dome form a combustor that defines a combustion chamber, the annular CMC combustor dome positioned at a forward end of the combustor; and a support structure for supporting the combustor, the support structure including an annular frame having a frame channel defining a groove, the first end of each tile of the plurality of tiles disposed within the groove of the frame channel, an inner support flange, and an outer support flange, wherein the inner liner flange is secured to the inner support flange and the outer liner flange is secured to the outer support flange, wherein the first side of each tile defines a first radial edge and the second side of each tile defines a second radial edge, each tile extending between the first end, the second end, the first radial edge, and the second radial edge, and wherein each of the first end, the second end, the first radial edge, and the second radial edge of each tile are defined in a respective common plane.

3. The combustor assembly of claim 2, further comprising: a CMC bracket including a bracket channel defining a groove, the second end of each tile of the plurality of tiles disposed within the groove defined by the bracket channel.

4. The combustor assembly of claim 3, wherein the CMC bracket is secured between the outer liner flange and the outer support flange such that the CMC bracket extends axially aft with respect to the support structure.

5. The combustor assembly of claim 3, wherein the support structure includes a plurality of first projections and a plurality of second projections radially spaced apart from the plurality of first projections, and wherein the plurality of first projections and the plurality of second projections are configured to axially load the annular CMC combustor dome into the frame channel and the bracket channel.

6. The combustor assembly of claim 2, wherein the frame channel extends axially from an aft surface of the annular frame of the support structure.

7. The combustor assembly of claim 2, wherein each tile of the plurality of tiles defines an aperture therein, and wherein a fuel nozzle is received in each aperture.

8. The combustor assembly of claim 7, wherein the annular frame of the support structure defines a plurality of windows, and wherein each fuel nozzle is disposed through a window of the plurality of windows.

9. The combustor assembly of claim 1, wherein the annular CMC combustor dome is positioned between the support structure and the combustion chamber.

10. The combustor assembly of claim 2, wherein the frame channel includes a plurality of ribs, wherein each tile of the plurality of tiles defines a slot, and wherein a rib of the plurality of ribs is received in each slot.

11. The combustor assembly of claim 2, wherein the inner support flange and the outer support flange are scalloped along a circumferential direction.

12. The combustor assembly of claim 2, wherein each tile defines an overlap portion along each of the first radial edge and the second radial edge, and wherein the overlap portions of adjacent tiles overlap one another.

13. The combustor assembly of claim 2, wherein the support structure is formed from a metallic material.

14. A combustor assembly, comprising:

an annular ceramic matrix composite (CMC) inner liner including an inner liner flange;

an annular CMC outer liner spaced apart from the annular CMC inner liner along a radial direction, the annular CMC outer liner including an outer liner flange;

an annular CMC combustor dome having a first end and a second end opposite to the first end along the radial direction, wherein the annular CMC inner liner, the annular CMC outer liner, and the annular CMC combustor dome form a combustor that defines a combustion chamber, the annular CMC combustor dome positioned at a forward end of the combustor;

a support structure for supporting the combustor, the support structure including an annular frame, an inner support flange, and an outer support flange;

an inner CMC bracket including a first inner bracket portion and an inner bracket channel at an aft end of the inner CMC bracket and aft of the first inner bracket portion, the inner bracket channel being perpendicular to the first inner bracket portion; and an outer CMC bracket including a first outer bracket portion and an outer bracket channel at an aft end of the outer CMC bracket and aft of the first outer bracket portion, the outer bracket channel being perpendicular to the first outer bracket portion;

wherein a first groove is defined by the CMC inner bracket, the inner bracket channel, and the annular frame, wherein a second groove is defined by the CMC outer bracket, the outer bracket channel, and the annular frame, wherein the first end of the annular CMC combustor dome is disposed within the first groove, wherein the second end of the annular CMC combustor dome is disposed within the second groove, wherein the annular CMC combustor dome is positioned between the support structure and the combustion chamber, and wherein an attachment mechanism extends through either (1) the inner CMC bracket and the inner liner flange to secure the inner CMC bracket between the annular CMC inner liner and the support structure, or (2) the outer CMC bracket and the outer liner flange to secure the outer CMC bracket between the annular CMC outer liner and the support structure.

15. The combustor assembly of claim 14, wherein the support structure includes a plurality of first projections and a plurality of second projections spaced apart from the plurality of first projections along the radial direction, and wherein the plurality of first projections and the plurality of second projections are configured to axially load the annular CMC combustor dome into the inner bracket channel and the outer bracket channel.

16. The combustor assembly of claim 14, wherein the annular CMC combustor dome comprises a plurality of tiles positioned circumferentially adjacent one another, the first end of the annular CMC combustor dome being defined by respective first ends of each tile of the plurality of tiles, the second end of the annular CMC combustor dome being defined by respective second ends of each tile of the plurality of tiles.

17. The combustor assembly of claim 16, wherein each tile of the plurality of tiles defines an aperture therein and the annular frame of the support structure defines a plurality of windows, and wherein a fuel nozzle is disposed through a window of the plurality of windows and is received in a respective aperture of a tile of the plurality of tiles.

18. The combustor assembly of claim 4, wherein the frame channel extends aft along an axial direction with respect to the support structure at a frame inner end, and wherein the groove defined by the frame channel opens toward the groove defined by the bracket channel.

* * * * *